US010486321B2

(12) United States Patent
Gratsias et al.

(10) Patent No.: US 10,486,321 B2
(45) Date of Patent: Nov. 26, 2019

(54) RAZOR HANDLE COMPRISING INSERTS WITHIN HOLES AND RAZOR COMPRISING SUCH A RAZOR HANDLE

(71) Applicant: BIC-VIOLEX SA, Anixi, Attiki (GR)

(72) Inventors: Spiros Gratsias, Kipseli-Athens (GR); Ioannis-Marios Psimadas, Vrilissia-Athens (GR); Georgios Georgakis, Melisia (GR); Efstratios Christofidellis, Kifisia (GR)

(73) Assignee: BIC VIOLEX SA, Anixi (GR)

( * ) Notice: Subject to any disclaimer, the term of this patent is extended or adjusted under 35 U.S.C. 154(b) by 68 days.

(21) Appl. No.: 15/115,939

(22) PCT Filed: Feb. 28, 2014

(86) PCT No.: PCT/EP2014/054008
§ 371 (c)(1),
(2) Date: Aug. 2, 2016

(87) PCT Pub. No.: WO2015/128000
PCT Pub. Date: Sep. 3, 2015

(65) Prior Publication Data

US 2017/0165854 A1 Jun. 15, 2017

(51) Int. Cl.
*B26B 21/52* (2006.01)
*B26B 21/22* (2006.01)

(52) U.S. Cl.
CPC ..... *B26B 21/522* (2013.01); *B26B 21/225* (2013.01); *B26B 21/521* (2013.01); *B26B 21/528* (2013.01)

(58) Field of Classification Search
CPC ... B26B 21/522; B26B 21/521; B26B 21/528; B26B 21/52; B26B 21/222
USPC ..... 30/526
See application file for complete search history.

(56) References Cited

U.S. PATENT DOCUMENTS 5,129,157 A * 7/1992 Wood ..... B25G 1/102 30/526
5,784,790 A * 7/1998 Carson, III ..... B26B 21/225 30/527
6,105,255 A * 8/2000 Cheng ..... B26B 1/046 30/155
D812,815 S * 3/2018 Psimadas ..... D28/48
D815,354 S * 4/2018 Psimadas ..... D28/48
D816,272 S * 4/2018 Psimadas ..... D28/48
2004/0216311 A1 11/2004 Follo
(Continued)

FOREIGN PATENT DOCUMENTS

WO WO 97/37819 A2 10/1997

OTHER PUBLICATIONS

International Search Report of PCT/EP2014/054008 dated Nov. 5, 2014.

*Primary Examiner* — Laura M Lee
(74) *Attorney, Agent, or Firm* — Polsinelli PC

(57) ABSTRACT

A razor handle is provided that includes an elongated body extending in a longitudinal direction. The elongated body has an outer surface and is provided with a first hole and a second hole. The first and second holes open on the outer surface of the elongated body. The razor handle further includes a first insert and a second insert. The first and second inserts are respectively partially encapsulated within the first and second holes.

22 Claims, 6 Drawing Sheets

(56) References Cited

U.S. PATENT DOCUMENTS

| | | | | |
|---|---|---|---|---|
| 2008/0163500 | A1* | 7/2008 | Bozikis | B26B 21/522 30/526 |
| 2012/0279039 | A1* | 11/2012 | Winter | B26B 21/521 29/428 |
| 2014/0230257 | A1* | 8/2014 | Eagleton | B26B 21/522 30/526 |

* cited by examiner

RAZOR HANDLE COMPRISING INSERTS WITHIN HOLES AND RAZOR COMPRISING SUCH A RAZOR HANDLE

This application is a national stage application of International Application No. PCT/EP2014/054008, filed Feb. 28, 2014, the entire content of which is incorporated herein by reference.

FIELD OF THE INVENTION

The embodiments of the present invention relate to a razor handle.

BACKGROUND OF THE INVENTION

In particular, the embodiments of the present invention relate to a razor handle that includes an elongated body extending in a longitudinal direction, the elongated body having an outer surface and being provided with a first hole and a second hole, the first and second holes opening on the outer surface of the elongated body, the razor handle further including a first insert and a second insert.

WO2008147133 describes an example of a razor handle in which several inserts are provided on different faces of the razor handle so as to provide a proper weight to the handle assembly and prevent the deformation of the elongated body.

However, these inserts consist of several different pieces with complex shapes; therefore, a razor handle provided with such inserts is difficult to assemble and to manufacture. In addition, each of these inserts can inadvertently be detached from the razor handle.

SUMMARY OF THE INVENTION

One objective of the present invention is to avoid the aforementioned drawbacks. More specifically, one objective of the present invention is to facilitate the manufacture of the razor handle according to the present invention.

Another objective is to improve the shaving experience of the user while shaving.

Another objective is to avoid any inadvertent separation of the inserts provided on razor handle according to the present invention.

This problem is solved by the present invention in that the first and second inserts are respectively partially encapsulated within the first and second holes.

By providing the inserts, the razor handle can also have a proper weight ensuring a precise and comfortable shaving while providing an advantage for mass produced shavers.

In addition, since the inserts are encapsulated within the elongated body, the inserts cannot be detached from the first and second holes; they especially cannot be detached from the hole by a user. Also, the razor handle has a better hold and an improved resistance.

By providing the inserts, the razor handle can also have a proper weight to promote a comfortable shaving experience. The inserts allow the razor handle to have a good balance regardless the shape of the handle.

Furthermore, the razor handle according to the present invention can be easily recycled by separating the material of the inserts from the material of the elongated body.

In other advantageous embodiments of the razor handle, at least one of the following features may be incorporated:

the razor handle extends between a front end and a rear end, the rear end being opposite the front end, the front end being provided with connecting means, the first insert being located proximate to the front end and the first insert being substantially immovable within the first hole, the substantially immovable first insert forming a finger rest area; consequently, the user can position one or several of his fingers on the first insert to grasp the handle; the razor handle thus provides a good shaving experience;

the first insert is movable within the first hole;

the second insert is substantially immovable within the second hole, the substantially immovable second insert forming a finger rest area; consequently, the user can position one or several of his fingers on the second insert to grasp the handle; the razor handle thus provides a good shaving experience;

the elongated body is a unitary element and includes a first material including a plastic or a rubber material;

the first and second inserts are made with a rigid material having a density that is different from the density of the first material of the elongated body; when the inserts include a material having a density that is greater than the density of the first material of the elongated body, the presence of the inserts result in an increase in the weight of the razor handle which can improve the user's perception while shaving; this increase of weight can be achieved by reducing the use of first material and still maintaining a good shaver handle design; the size and shape of the razor handle may be then reduced but may still keep an ergonomic shape;

the first and second inserts include a material including a metal, a plastic, or a rubber material;

at least one of the first and second inserts is a sphere; each of the first and second inserts can be a sphere;

the first and second inserts each has a diameter between about 10 mm and about 20 mm;

the elongated body has an upper face and a lower face, the lower face being opposite the upper face, the first and second holes being through-holes extending between the upper and lower faces;

the elongated body has an upper face and a lower face, the lower face being opposite the upper face, at least a part of the upper face and at least a part of the lower face being covered with a second material so that the parts respectively form at least an upper gripping area and at least a lower gripping area;

the elongated body has two lateral sides opposite to each other and extending in the longitudinal direction between the upper and lower faces, the lateral sides including a plurality of smooth ribs made of the second material, each of the plurality of smooth ribs connecting the upper gripping area and the lower gripping area;

the razor handle extends between a front end and a rear end, the rear end being opposite the front end, the front end being provided with connecting means for connection to a shaving cartridge;

the first insert is located proximate to the front end, whereas the second insert is located proximate to the rear end;

the first insert is centered on a first point which is located at a distance measured along the longitudinal direction about 30 mm from the front end;

the second insert is centered on a second point which is located at a distance measured along the longitudinal direction about 20 mm from the rear end;

the distance between the first point and the second point measured along the longitudinal direction is between about 70 mm and about 90 mm;

each lateral side includes a plurality of spaced protruding pins proximate to the front end of the razor handle;

the first hole has an interior lateral wall, a retaining ring protruding from the interior lateral wall and surrounding circumferentially, at least partially, the first insert to maintain the first insert within the first hole;

the second hole is divided by an elongated bar extending in the longitudinal direction, the elongated bar that includes a portion that surrounds circumferentially, at least partially, the second insert to maintain the second insert within the second hole;

the second hole includes an interior lateral wall, the second hole further includes two projections opposite each other, the two projections protruding from the interior lateral wall and having a shape which is partly complementary to the shape of the second insert to maintain the second insert within the second hole; and each of the first and second holes delimits an interior space inside the elongated body, the first and second inserts having a size which is respectively smaller than the interior spaces of the first and second holes.

The present invention also concerns a razor that includes such a razor handle and a shaving cartridge connected to the razor handle.

The above and other objects and advantages of the present invention will become apparent from the detailed description of embodiments of the present invention, considered in conjunction with the accompanying drawings.

DETAILED DESCRIPTION

In the various figures, the same references can denote identical or similar elements.

Figure 1:
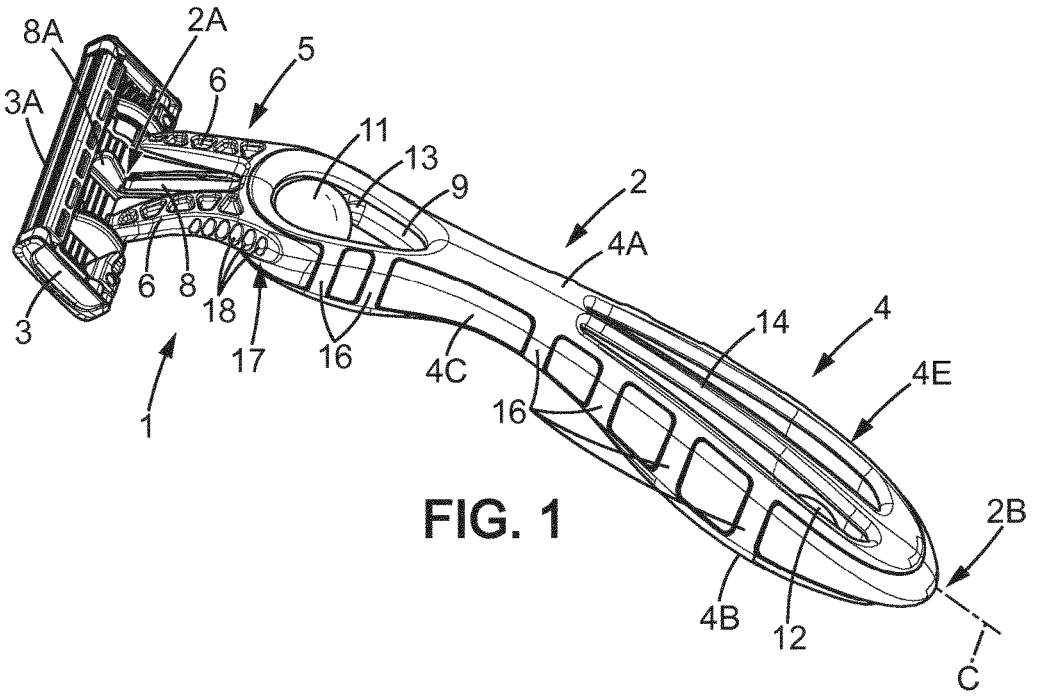
FIG. 1 is a perspective view of a razor according to the present invention that includes a razor handle connected to a shaving cartridge.
Figure 2:
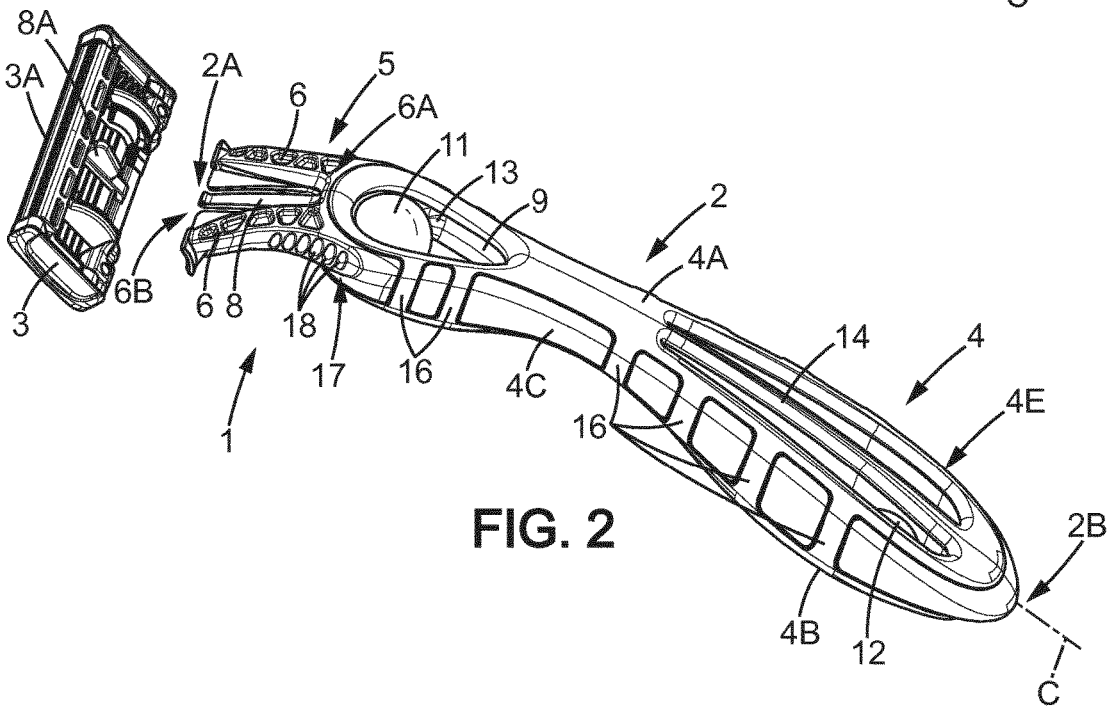
FIG. 2 is a perspective view of the razor of FIG. 1, the shaving cartridge being released from the razor handle.

FIG. 1 illustrates a wet shaving razor 1. The present invention includes a razor handle 2 and a shaving cartridge 3. The shaving cartridge 3 is preferably a disposable shaving cartridge that includes one or more blades 3A, which can be connected to or released from the razor handle 2 as shown respectively on FIGS. 1 and 2.

The razor handle 2 has a generally curved shape (viewed laterally) and extends in a longitudinal direction C between a front end 2A and a rear end 2B, the rear end 2B being opposite the front end 2A. The razor handle 2 also has an elongated body 4 for hand grasping the razor handle The elongated body 4 extends longitudinally from the rear end 2B to a location near the front end 2A. The razor 1 further includes connecting means 5 in the continuation of the elongated body 4 up to the front end 2A of the razor handle 2. In other words, the elongated body 4 extends longitudinally from the rear end 2B to the beginning of the connecting means 5. The shaving razor 1 extends longitudinally from the rear end 2B to the free end of the connecting means 5 (the free end being connected to the shaving cartridge 3).

Figure 3A:
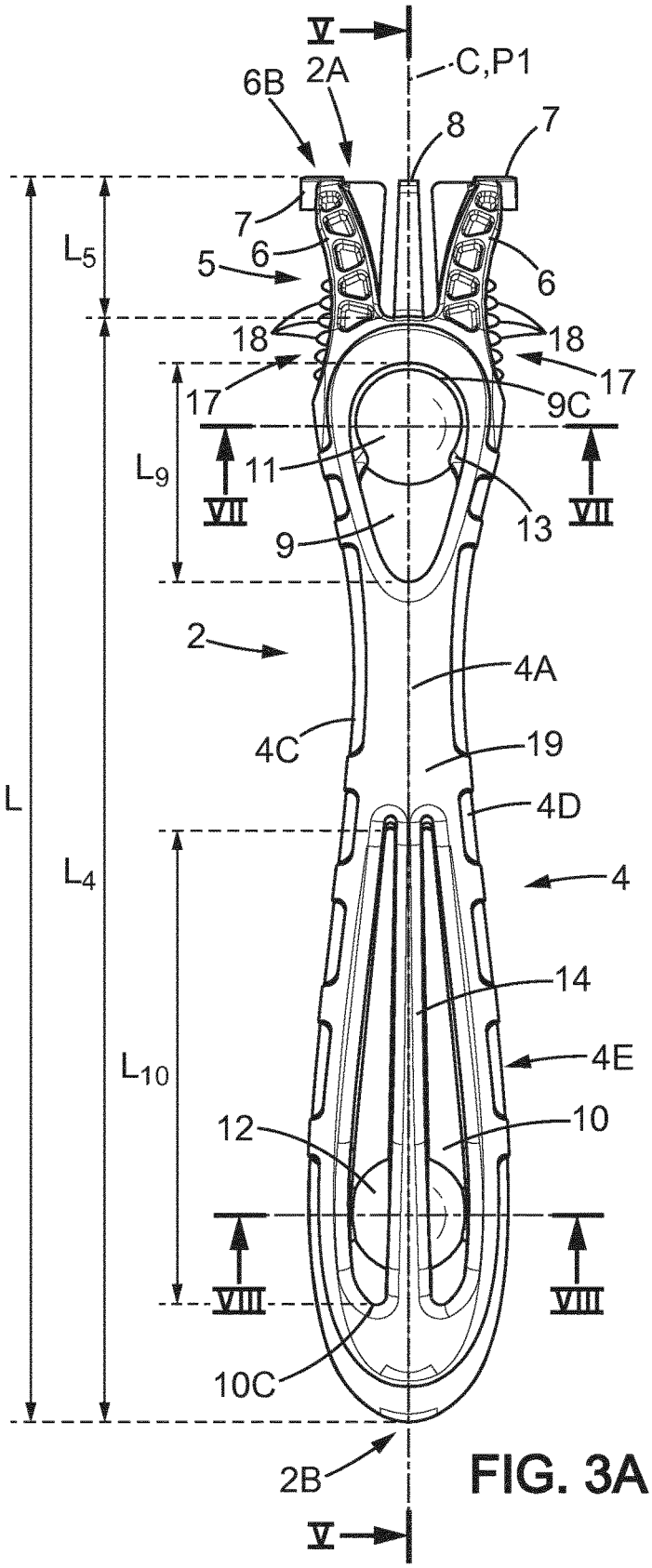
FIGS. 3A and 3B are respectively an upper and a lower view of the razor handle of FIG. 1.
Figure 3B:
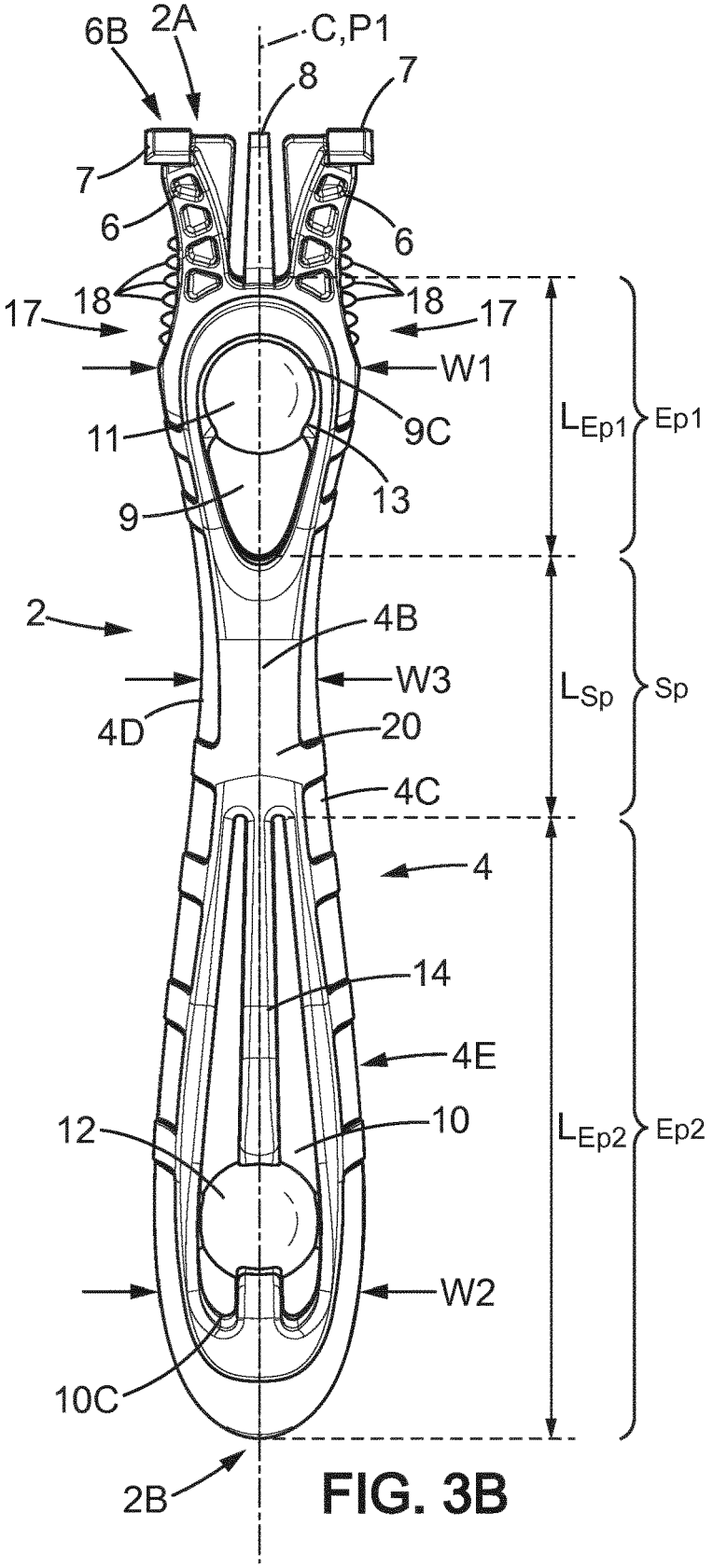

Referring to FIGS. 3A and 3B, the razor handle 2 can be substantially symmetrical with respect to a median plane P1 and has a length L in the longitudinal direction C which is between about 100 mm and about 150 mm, preferably about 125 mm. The length L4 of the elongated body 4 is about 100 mm to about 120 mm, whereas the length L5 of the connecting means 5 is about 15 to about 25 mm.

In an embodiment of the present invention, the length L of the razor handle 2 is about 126 mm. The length L5 of the connecting means 5 is about 17 mm. The length L4 of the elongated body 4 is about 108 mm.

Figure 4:
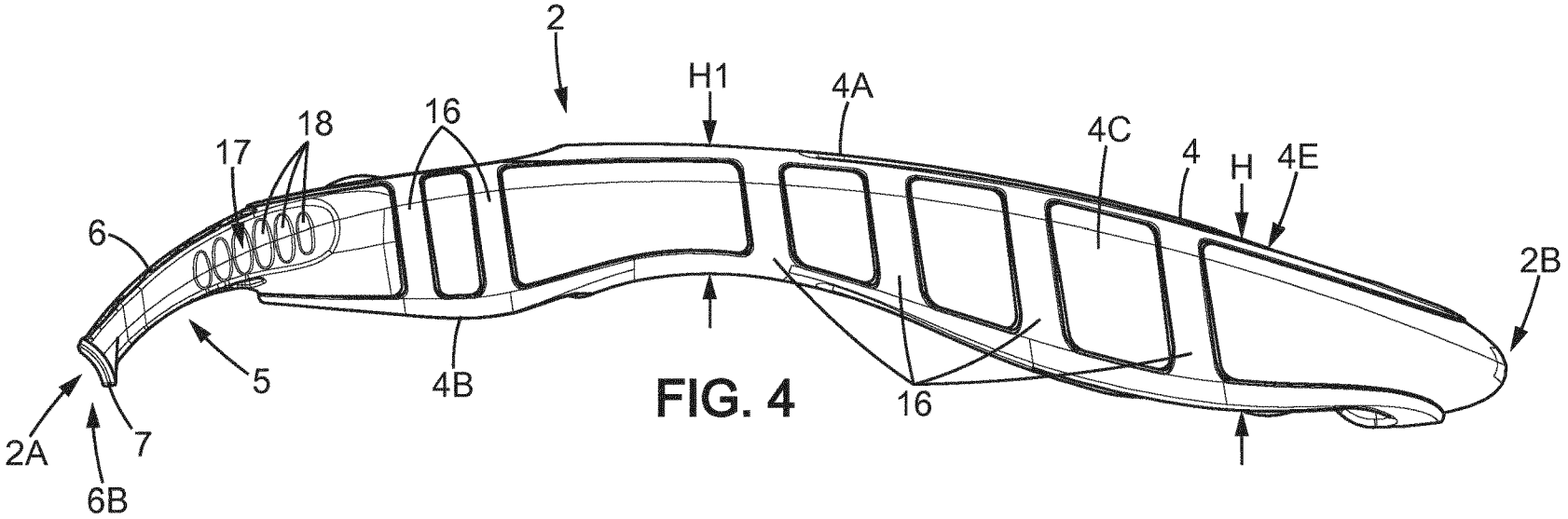
FIG. 4 is a side view of the razor handle of FIG. 1.

The razor handle 2 may also define a variable height H and a width W along the length L thereof. The height H of the razor handle 2 may vary along the direction C but is preferably between about 15 mm and about 25 mm, preferably about 20 mm. As depicted in FIG. 4, the smallest height H1 of the elongated body 4 is located about the center of the razor handle 2.

It can be seen on the upper and lower views of the razor handle 2, shown in FIGS. 3A and 3B, that the razor handle 2 has a first enlarged part Ep1 proximate to the front end 2A, having a width W1 which is maximized. The elongated body also includes a second enlarged part Ep2 located proximate to the rear end 2B of the razor handle 2 having a width W2 which is maximized. The first and second enlarged parts Ep1, Ep2 are connected together by a slim part Sp located about at the center of the razor handle 2. In particular, the slim part Sp has a width W3 which is minimized. The first enlarged part Ep1 extends from the slim part Sp to the connecting means 5, whereas the second enlarged part Ep2 extends from the rear end 2B to the slim part Sp. The first and the second enlarged parts Ep1, Ep2 have a length LEp1, LEp2 along the longitudinal direction C which are respectively chosen such that the connection between the first and second enlarged parts Ep1, Ep2 with the slim part Sp have a smooth curvature.

In a preferred embodiment of the present invention, the length LEp1 of the first enlarged part Ep1 is about 25 mm. The length LEp2 of the second enlarged part Ep2 is about 50 mm. The length LSp of the slim part Sp is about 25 mm.

The connecting means 5 are integral with the elongated body 4 and includes two flexible arms 6 extending from the elongated body 4 and protruding toward a free end 6B at the front end 2A of the razor handle 2. In other words, the flexible arms 6 and the elongated body 4 are unitary.

Figure 9:
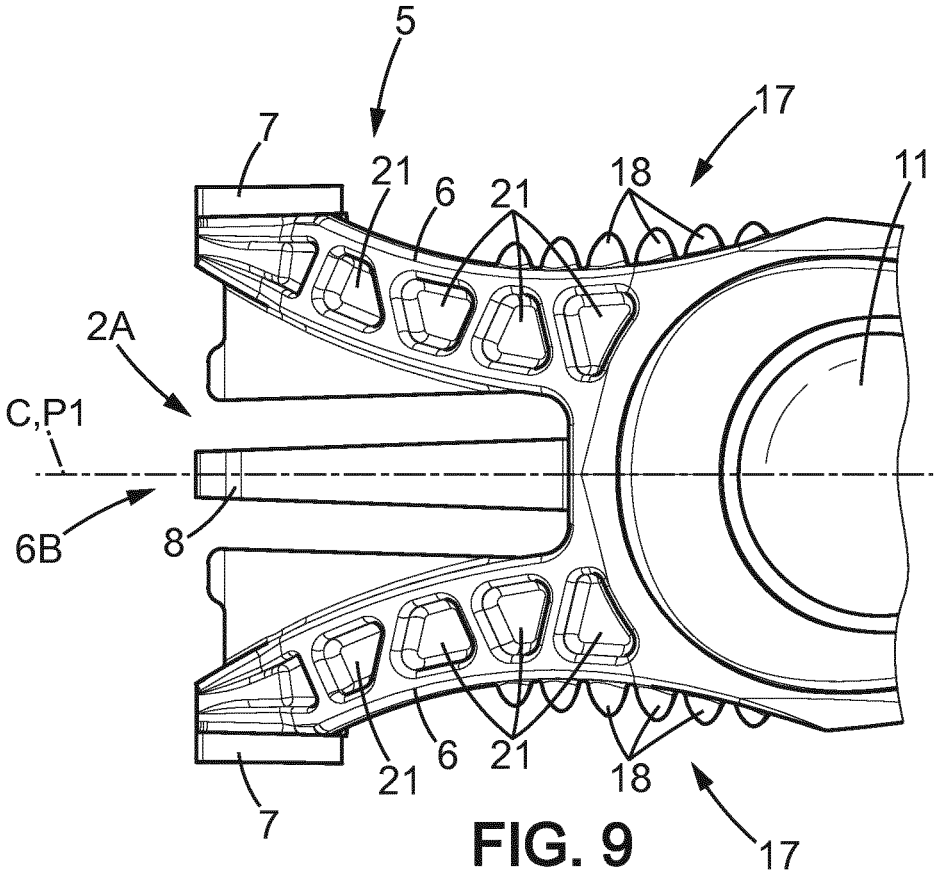
FIG. 9 is a partial upper view of the front end of the razor handle of FIG. 3A.

As shown in FIG. 9, the two arms 6 may be disposed in a V shape, diverging from the longitudinal direction C of the razor handle 2. Each of the two arms 6 is provided at the free end 6B with a bearing structure 7 for connection to the shaving cartridge 3. In the illustrated embodiment of the present invention, the shaving cartridge 3 is of the pivotal type, where the bearing structures 7 allow the pivoting of the shaving cartridge 3 when connected to the razor handle 2. A longitudinal flexible tongue 8, extending between the arms 6 and cooperating with a groove 8A (shown in FIG. 2) formed on the shaving cartridge 3, provides a spring force which biases the shaving cartridge 3 towards a rest position as illustrated in FIG. 1. In other embodiments of the present invention, the shaving cartridge 3 may also be fixed relatively to the razor handle 2.

Each arm 6 has on its upper face a plurality of small cavities 21, which provides enough structural strength to the connecting means 5 for the purposes of human shaving while saving weight and costs on this part of the razor handle 2.

The elongated body 4 has an outer surface 4E, and more precisely an upper face 4A and a lower face 4B (also shown in FIGS. 4A and 4B), the lower face 4B being opposite the upper face 4A. The elongated body 4 further has two lateral sides 4C, 4D between the upper and lower faces 4A, 4B. The two lateral sides 4C, 4D are opposite each other and also extend in the longitudinal direction C.

The elongated body 4 and the connecting means 5 form a unitary element moulded out of a first material. The first material may be any moldable material. Preferably, the first material is chosen among a plastic or a rubber material. For instance, the elongated body 4 and the connecting means 5 can be moulded in a thermoplastic material, for instance in acrylonitrile butadiene styrene (ABS) or in polypropylene (PP).

The elongated body 4 further includes a first hole 9 and a second hole 10. The first and second holes 9, 10 are respectively located in the first enlarged part Ep1 and in the second enlarged part Ep2 of the razor handle 2.

The first and second holes 9, 10 are preferably through-holes that extend between the upper face 4A and the lower face 4B of the elongate body 4. In other embodiments of the present invention, the first and second holes 9, 10 may also be blind holes that open on the outer surface 4E of the elongated body 4, and in particular on the upper face 4A or on the lower face 4B.

Figure 8:
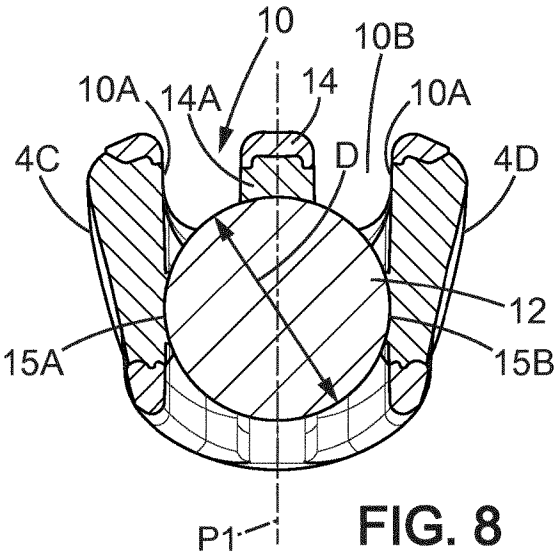
FIG. 8 is a cross-sectional view of the razor handle shown in FIG. 3A along line VIII-VIII.
Figure 7:
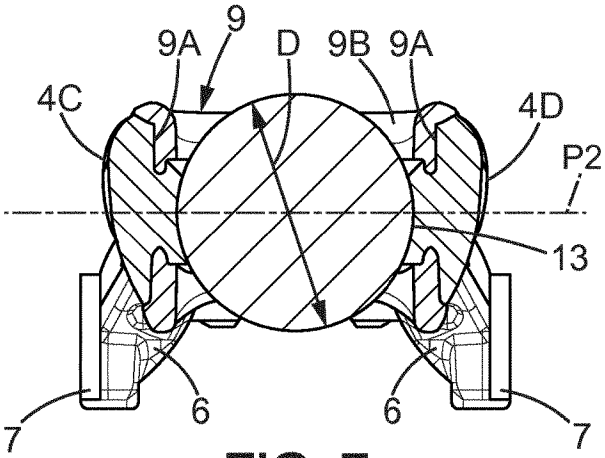
FIG. 7 is a cross-sectional view of the razor handle shown in FIG. 3A along line VII-VII.

As shown in FIGS. 7 and 8, each of the first and second holes 9, 10 has respectively an interior side wall 9A, 10A, each of which are delimiting an interior space 9B, 10B inside the elongated body 4 between the upper and the lower faces 4A, 4B. The interior side walls 9A, 10A of each of the first and second holes 9, 10 have a semi-circular portion 9C, 10C (shown in FIG. 3A) and converge in a V-shape from the semi-circular portions 9C, 10C in the longitudinal direction C towards the slim part Sp in the center of the razor handle 2. Also, both of the first and second holes 9, 10 preferably have drop-shapes respectively oriented in opposite directions when seen from an upper or a lower view as illustrated in FIGS. 3A and 3B. In other words, viewed from the top or lower side, the two holes connected via the slim part Sp, have a general shape similar to a figure eight.

As shown in FIG. 3A, the length L9 of the first hole 9 along the longitudinal direction is between about 10 mm and about 30 mm, preferably about 20 mm. The length L10 of the second hole 10 along the longitudinal direction is between about 30 mm and about 50 mm, preferably about 40 mm. Also, as illustrated in FIG. 3B, the first enlarged part Ep1 extends from the connecting means 5 to the end of the first hole 9 located towards the center of the razor handle 2. The slim part Sp extends from the end of the first hole 9 located towards the center of the razor handle 2 to the end of the second hole 10 also located towards the center of the razor handle 2. The second enlarged part Ep2 extends from the end of the second hole 10 located towards the center of the razor handle 2 to the rear end 2B.

Figure 5:
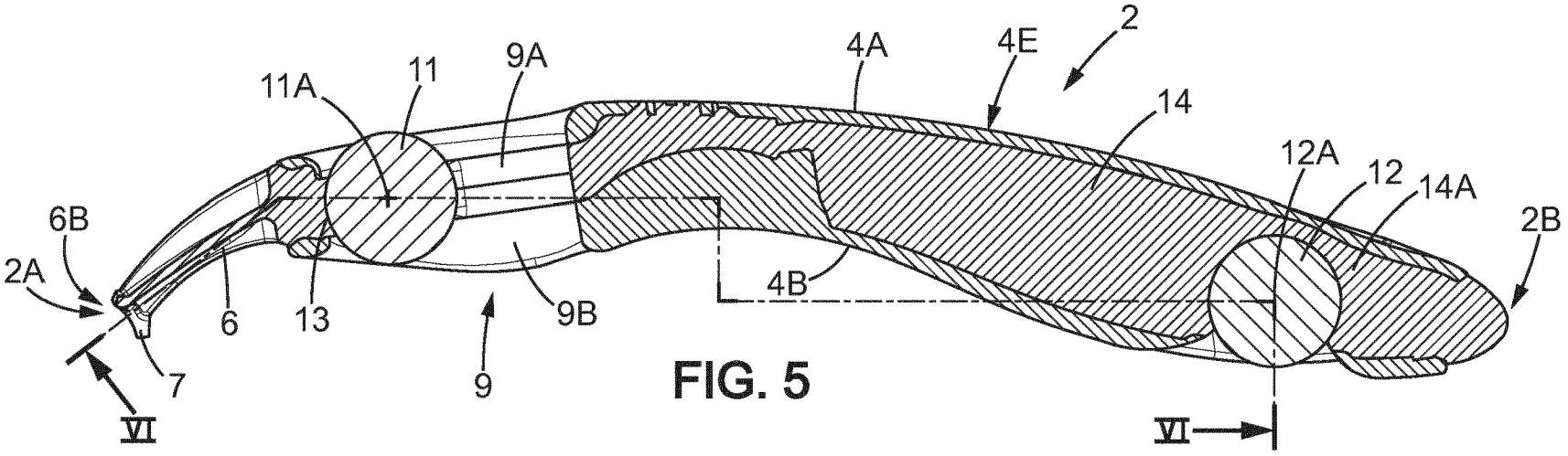
FIG. 5 is a longitudinal cross-sectional view of the razor handle shown in FIG. 3A along line V-V.
Figure 6:
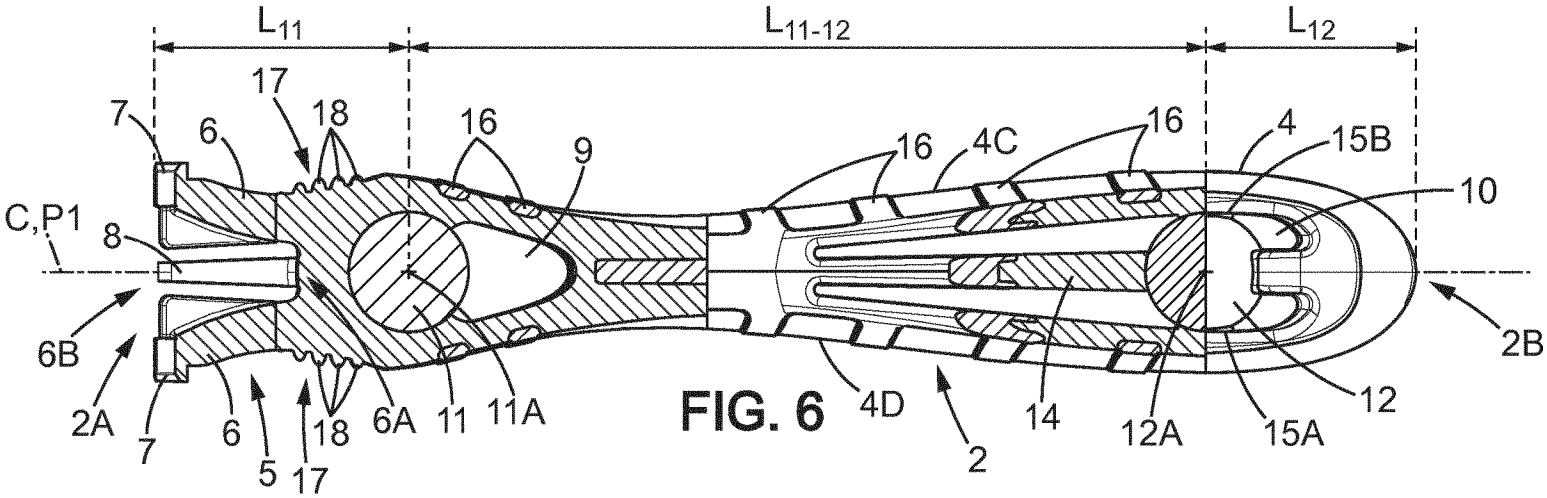
FIG. 6 is a cross-sectional view of the razor handle shown in FIG. 5 along line VI-VI.

The razor handle 2 further includes a first insert 11 and a second insert 12 located respectively within the interior space 9B, 10B of each of the first and second holes 9, 10. More precisely, the first and second inserts 11, 12 are respectively partially encapsulated within the first and second holes 9, 10 as illustrated in FIG. 5. The surface of the first and second inserts 11, 12 can be directly or indirectly, as detailed hereafter, touchable with a finger of a user. The surface of each of the first and second inserts 11, 12 can form finger rest areas on the upper face 4A and/or on the lower face 4B of the elongated body 4. Preferably, less than 75%, and preferably less than 50%, of the surfaces of the first and second inserts 11, 12 are encapsulated within the first and second holes 9, 10. In other words, the surface of the first and second inserts 11, 12 which is encapsulated cannot be directly touched by the user as it is surrounded with the first material of the elongated body 4.

In this manner, when a user wants to shave, he may position his fingers on the location of the first and second holes 9, 10, and preferably on the surfaces of the first and second inserts 11, 12 which are not encapsulated. Preferably, the first and second inserts 11, 12 enhance hand grasping in certain shaving positions, such as in a position where the razor handle 2 is held between the index and the thumb, the thumb resting on the first insert 11 on the upper face 4A and the index resting on the first insert 11 on the lower face 4B of the razor handle 2. In another shaving position, the thumb and the index of the user can also rest on the second insert 12. As will be discussed further below, the second insert 12 may not be directly touched with a finger of a user on the upper face 4A as a rib 14 may cover partially the second insert 12. The user may therefore position his finger(s) on the rib 14 on the upper face 4A of the elongated body 4 when shaving. Although covered by the rib 14, the second insert 12 can form a finger rest area since the second insert 12 supports the rib 14. In other embodiments of the present invention, the second insert 12 can be covered at least partially with another material (i.e. the material of the rib 14).

The first and second inserts 11, 12 are preferably made with a material chosen among a metal, a plastic, and a rubber material. In particular, the first insert 11 and/or the second insert 12 is preferably made with a rigid material having a density that is significantly different from the density of the first material of the elongated body 4.

For instance, the density of the first and second inserts 11, 12 may be greater than the density of the first material of the elongated body 4. The first and second inserts 11, 12 thus contribute to increasing the weight of the razor handle 2 without significantly increasing the volume of the handle 2. As a consequence, the razor handle 2 can be heavy enough to provide a good shaving and to make sure that a good contact is provided between the blades 3A of the shaving cartridge 3 and the skin of the user to be shaved. Preferably, each of the first and second inserts 11, 12 is only made of metal and does not include any other material.

The material chosen for the first insert 11 and/or the second insert 12 can also have an impact on the sensing 5 experience of the user when he positions his fingers on the first and second inserts 11, 12. For example, an insert made of metal provides a pin-point contact with the fingers of the user, thus allowing the communication of all transmitted vibrations from shaving. To the contrary, an insert made of rubber, such as thermoplastics, absorbs most of the vibrations from shaving and does not transmit them to the fingers of the user.

In alternative embodiments of the present invention, the first and second inserts 11, 12 may not be both necessarily of the same material. For instance, the first insert 11 provided within the first hole 9 may be made of metal and the second insert 12 provided within the second hole 10 may be made of rubber or vice versa.

Each of the first and second inserts 11, 12 can also be made with several materials. In particular, the first and second inserts 11, 12 can be covered with a layer of another material having a smooth surface. For example, the first and second inserts 11, 12 may be made of metal and covered by a layer of rubber. The layer can have a surface finish between about 0.5 pm and about 1.6 pm (roughness Ra).

The first and second inserts 11, 12 may also have an irregular surface, for instance with craters or bumps due to a knurled pattern or a divot pattern. The type of surface of the first and second inserts 11, 12 can affect the tactile sensing of the user when he positions his fingers on the first and second inserts 11.

In other alternative embodiments of the present invention, the first insert 11 and/or the second insert 12 may be a sphere of which one hemisphere is made of rubber and the other hemisphere is made of plastic. The first and second inserts 11, 12 may thus serve a double purpose by providing different types of finger rest areas.

By providing the first and second inserts 11, 12, the elongated body 4 can therefore be made of a material which is lighter and cheaper when compared to the material used in known razor handles. Nevertheless, despite the lightness of the first material, the razor handle 2 still has a good quality appearance and an optimized weight due to the first and second inserts 11, 12. The weight of the razor handle 2 is localized in the front end 2A and the rear end 2B of the razor handle 2, thus ensuring a good balance of the razor handle 2.

The first insert 11 and/or the second insert 12 may have a spherical shape. The first inserts 11 and/or the second insert 12 may have an ovoid shape. More generally, the inserts may have any other shape such as a parallelepipedic, cubical or cylindrical shape. The first and second inserts 11, 12 may have the same shape or may have a different one. Similarly, first and second inserts 11, 12 may have the same dimensions or may have different ones. The first and second inserts 11, 12 may be made of the same material(s) or may be made of a different one(s).

Preferably, the inclusion of the first and second inserts 11, 12 does not lead to an excessive deformation of the shape of the elongated body 4. The shape of the elongated body 4 preferably remains similar to the shape of an elongated body that would not include any inserts. As shown in FIGS. 1-3 and 5-8, each of the first and second inserts 11, 12 is preferably a single sphere. However, each of the first and second inserts 11, 12 may not be complete spheres and may only have a partial curved surface, especially a partial spherical surface which serves as a finger rest area.

The first and second inserts 11, 12 have a size which is respectively inferior to the interior spaces 9B, 10B of each first and second hole 9, 10. Also, as illustrated in FIGS. 3A and 3B, the length of the first and second holes L9, L10 in the longitudinal direction C is greater than the longitudinal size of the first and second inserts 11, 12. In the illustrated embodiment of the present invention in which the inserts are spheres, the spheres have preferably a diameter D which is between about 10 mm and about 20 mm, preferably less than about 15 mm, and more preferably about 12 mm.

In one embodiment of the present invention, the first and second inserts 11, 12 are preferably maintained, or advantageously secured, respectively within the first and second holes 9, 10 and can therefore not be detached from the first and second holes 9, 10 by a user. The first and second inserts 11, 12 cannot move substantially in any manner in the first and second holes 9, 10. As a consequence, the first and second inserts 11, 12 are not substantially movable (i.e. immovable or motionless) respectively relative to the first and second holes 9, 10. The substantially non-movable first and second inserts 11, 12 thus form finger rest areas. More precisely, the first and second inserts 11 and 12 cannot substantially slide in their corresponding first and second holes 9, 10.

More particularly, as depicted in FIG. 7, a retaining ring 13 protrudes from the interior side wall 9A of the first hole 9 in a plane P2 perpendicular to the symmetry plane P1 of razor handle 2 and partially surrounds circumferentially the first insert 11 to maintain the first insert 11 within the first hole 9.

In another embodiment of the present invention, the first insert 11 and/or the second insert 12 may be a sphere that can rotate about its own axis in all directions. Also, a gap may be provided between the first insert 11 and the retaining ring 13 in order to facilitate the rotation of the first insert 11 when the first insert 11 is a sphere. The gap may be between about 0.005 pm and about 0.025 pm depending on the chosen rotational freedom of the first insert 11. A smaller gap prevents the first insert 11 from rotating easily whereas a bigger gap facilitates the rotation. The surface finish of the first insert 11 and/or the second insert 12 and/or of the first hole 9 and/or the second hole 10 is adapted to allow movability, especially the rotation.

One among the first insert 11 and/or the second insert can be substantially immovable. In another embodiment of the present invention, both the first insert 11 and the second insert 12 are movable. The first insert 11 and the second insert 12 can for instance be spheres that are movable, especially in sliding around their own axis within their corresponding first and second holes 9, 10.

In the case where the first and/or second inserts 11, 12 include two hemispheres made of different materials and thus having different density, the user can switch between the two hemispheres as needed by rotating the first and second inserts 11, 12.

A user that positions one of his fingers on a movable first insert 11 and/or second insert 12 may find difficulty shaving as his finger(s) may slip on the first insert 11 and/or the second insert 12. Shaving may therefore be imprecise and uncomfortable.

As a consequence, when the first or second insert 11, 12 is movable relative to corresponding first or second holes 9, 10, it cannot form fingers rest areas. More precisely, when the first insert 11 is movable, the first insert 11 cannot be a finger rest area.

As illustrated in FIG. 8, the second hole 10 can be divided in two parts by an elongated bar 14 extending in the longitudinal direction C and within the second hole 10 in the plane P1. The elongated bar 14 includes a portion 14A that partially surrounds circumferentially the second insert 12 to maintain the second insert 12 within the second hole 10. The interior side wall 10A of the second hole 10 also includes two small projections 15A, 15B opposite each other that protrude from the interior side wall 10A and have a shape which is partly complementary to the shape of the second insert 12 to maintain the second insert 12 within the second hole 10. However, as described above regarding the first insert 11, a gap may also be provided between the second insert 12 and the portion 14A in order to facilitate the rotation of the second insert 12 when this second insert 12 is a sphere.

By being respectively maintained in the first and second holes 9, 10, the first and second inserts 11, 12 are respectively located in the front end 2A and the rear end 2B of the razor handle 2. Preferably, the first insert 11 is centered on a first point 11A which is located at a distance L11 measured along the longitudinal direction (C) of about 25 mm from the front end 2A. The second insert 12 is located proximate to the rear end 1B. Preferably, the second insert 12 is centered on a second point 12A which is located at a distance L12 measured along the longitudinal direction C of about 25 mm from the rear end 2B.

As illustrated in FIG. 5, the first and second inserts 11, 12 are spheres, and the first point 11A and the second point 12A respectively correspond to the center of the first and second inserts 11, 12.

The distance L11-12 (shown in FIG. 6) between the first point 11A and the second point 12A measured along the longitudinal direction (C) is preferably between about 60 mm and about 100 mm, preferably about 78 mm. The distance L11-12 may vary depending on the length L4 of the elongated body 4 as well as on the weight balance to be preferred due to the first and second inserts 11, 12.

In particular, known razors without inserts usually have a center of balance that is located in the center of the razor handle, or slightly towards the front end toward the razor handle. To this end, the rear part of the razor handle cannot be much larger than its front part, and vice versa, in order to achieve this center of balance. In the present invention, by adding the first and second inserts 11, 12 at precise locations from the front end 2A and the rear end 2B of the razor handle 2, it is possible to control the location of this center of balance regardless the shape of the razor handle 2. For instance, the center of balance may be positioned at the center of the razor handle 2 in the longitudinal direction (C) even though the second enlarged part Ep2 is significantly larger than the first enlarged part Ep1.

The elongated body 4 may be made with several different materials. For instance, the elongated body 4 may also be made with a layer of a second material different from the first material, preferably chosen among a plastic or a rubber material. The first material provides structural strength to the razor handle 2, while the second material provides the softness required for comfortable hand grasping and firm finger gripping in any shaving position.

As depicted in FIGS. 3A and 3B, at least a part 19 of the upper face 4A and at least a part 20 of the lower face 4B, and preferably the majority of these faces 4A, 4B, can be covered with the second material so that the parts 19, 20 respectively form an upper gripping area and a lower gripping area. As depicted in FIG. 7, the second material may also overflow, at least partially, on the interior side wall 9B of the first hole 9 without covering the retaining ring 13 which maintains the first insert 11.

The lateral sides 4C, 4D of the elongated body 4 include a plurality of smooth ribs 16 made of the second material. As shown in FIG. 4, each lateral side 4C, 4D of the elongated body 4 preferably includes a plurality of ribs 16 connecting together the upper and lower gripping areas 19, 20. In the illustrated embodiment shown in FIG. 4, each of the lateral sides 4C, 4D of the first enlarged part Ep1 includes two ribs 16 and the lateral sides 4C, 4D of the second enlarged part Ep2 includes four ribs 16.

As shown in FIGS. 1-4 and 9, each lateral side 3C, 4D may also have a side gripping area 17 that includes a plurality of spaced protruding pins 18 integral with the connecting means 5 and located proximate to the front end 2A of the razor handle 2 at the junction of the connecting means 5 with the elongated body 4. The side gripping areas 17 enhance finger gripping of the razor handle 2, especially in a shaving position where the thumb and the index finger are positioned very close to the front end 2A, and preferably to the arms 6 for satisfying the need of precise shaving.

According to the present invention, the insert (first and/or second) can be movable or substantially immovable in its corresponding hole; the insert (first and/or second) can be a sphere or of any other shape allowing the movability of the insert. The material and/or the surface finish of the insert (first and/or second) and/or of the hole (first and/or second) is adapted to allow this movability, especially by rotation. The insert (first and/or second), even when movable, is not detachable from the handle when inserted in the corresponding hole.

The invention claimed is:

1. A razor handle comprising:

an elongated body extending in a longitudinal direction, the elongated body having an upper outer face and a lower outer face defining an outer surface of the elongated body, the outer surface being provided with a first hole and a second hole, each of the first hole and the second hole extending from the upper outer face to the lower outer face through the elongated body and opening on the outer surface to define an interior space; and a first insert and a second insert, the second hole being divided by an elongated bar extending in the longitudinal direction, and the elongated bar including a portion that at least partially surrounds the second insert to maintain the second insert within the second hole.

2. The razor handle according to claim 1, wherein the razor handle extends between a front end and a rear end, the rear end being opposite the front end, the front end being provided with connecting means, wherein the first insert is located proximate to the front end and is substantially immovable within the first hole, the substantially immovable first insert forming a finger rest area.

3. The razor handle according to claim 1, wherein the first insert is movable within the first hole.

4. The razor handle according to claim 1, wherein the second insert is substantially immovable within the second hole, the substantially immovable second insert forming a finger rest area.

5. The razor handle according to claim 1, wherein the elongated body is a unitary element formed from a first material selected from the group consisting of a plastic or a rubber material.

6. The razor handle according to claim 5, wherein the first and second inserts are made with a rigid material having a density that is different from a density of the first material of the elongated body.

7. The razor handle according to claim 1, wherein the first and second inserts are formed from a material selected from the group consisting of a metal, a plastic, or a rubber material.

8. The razor handle according to claim 1, wherein at least one of the first and second inserts is a sphere.

9. The razor handle according to claim 8, wherein at least one of the first and second inserts has a diameter between about 10 mm and about 20 mm.

10. The razor handle according to claim 1, wherein the lower face is opposite the upper face, and the first and second holes are through-holes extending between the upper and lower faces.

11. The razor handle according to claim 1, wherein the elongated body is a unitary element formed from a first material with the lower face being opposite the upper face, and at least a part of the upper face and at least a part of the lower face is covered with a second material so that the parts respectively form at least an upper gripping area and at least a lower gripping area.

12. The razor handle according to claim 11, wherein the elongated body has two lateral sides opposite each other and extending in the longitudinal direction between the upper and lower faces, the two lateral sides including a plurality of smooth ribs made of the second material, wherein each of the plurality of smooth ribs connect the upper gripping area and the lower gripping area.

13. The razor handle according to claim 12, wherein the razor handle extends between a front end and a rear end, the rear end being opposite the front end, the front end being provided with connecting means for connection to a shaving cartridge.

14. The razor handle according to claim 13, wherein the first insert is located proximate to the front end, whereas the second insert is located proximate to the rear end.

15. The razor handle according to claim 13, wherein the first insert is centered on a first point which is located at a distance measured along the longitudinal direction of about 30 mm from the front end.

16. The razor handle according to claim 15, wherein the second insert is centered on a second point which is located at a distance measured along the longitudinal direction of about 20 mm from the rear end.

17. The razor handle according to claim 16, wherein the distance between the first point and the second point measured along the longitudinal direction is between about 70 mm and about 90 mm.

18. The razor handle according to claim 13, wherein each of the two lateral sides includes a plurality of spaced protruding pins proximate to the front end of the razor handle.

19. The razor handle according to claim 1, wherein the first hole forms an interior lateral wall defining the interior space within the elongated body, a retaining ring protrudes from the interior lateral wall and surrounds circumferentially, at least partially, the first insert to maintain the first insert within the first hole.

20. The razor handle according to claim 1, wherein the first and second inserts each have a size smaller than a size of the respective first and second holes, such that the first and second inserts are partially surrounded by the elongated body.

21. The razor handle according to claim 1, wherein the second hole forms an interior lateral wall defining the interior space within the elongated body, the second hole further including two projections opposite each other, the two projections protruding from the interior lateral wall and having a shape which is partly complementary to the shape of the second insert to maintain the second insert within the second hole.

22. The razor handle according to claim 1, wherein each of the first and second holes delimits the interior space inside the elongated body, the first and second inserts having a size which is respectively smaller than the interior spaces of the first and second holes.

* * * * *